US005558493A

United States Patent [19]

Hayashi et al.

[11] Patent Number: 5,558,493

[45] Date of Patent: Sep. 24, 1996

[54] FORCED AIR COOLING APPARATUS HAVING BLOWER AND AIR CURRENT REGULATING PLATE THAT REDUCES EDDY AIR CURRENT AT INLET OF BLOWER

[75] Inventors: Yutaka Hayashi; Mitsuo Miyamoto; Michihito Watarai, all of Hadano; Takayuki Atarashi, Tsuchiura; Tetsuya Tanaka, Niihari-gun; Toshio Hatada, Tsuchiura; Yoshihiro Takada, Niihari-gun; Takahiro Daikoku, Ushiku, all of Japan

[73] Assignee: Hitachi, Ltd., Tokyo, Japan

[21] Appl. No.: 477,653

[22] Filed: Jun. 7, 1995

[30] Foreign Application Priority Data

Jul. 18, 1994 [JP] Japan ..... 6-165047

[51] Int. Cl.[6] ..... F04D 29/66

[52] U.S. Cl. ..... 415/208.1; 415/119; 415/183

[58] Field of Search ..... 415/119, 183, 415/208.1, 206

[56] References Cited

U.S. PATENT DOCUMENTS

| | | | |
|---|---|---|---|
| 1,390,237 | 9/1921 | Conder | 415/208.1 |
| 2,201,437 | 5/1940 | Kice, Jr. | 415/183 |
| 2,204,912 | 6/1940 | Riebel, Jr. et al. | 415/183 |
| 2,233,991 | 3/1941 | Walters | 415/183 X |
| 2,727,680 | 12/1955 | Madison et al. | 415/183 |
| 3,480,202 | 11/1969 | Stephenson, Jr. | 415/208.1 X |
| 4,573,869 | 3/1986 | Kitamoto | 415/206 X |
| 4,690,006 | 7/1987 | Fisher | 415/119 |

*Primary Examiner*—Edward K. Look
*Assistant Examiner*—Michael S. Lee
*Attorney, Agent, or Firm*—Fay, Sharpe, Beall, Fagan, Minnich & McKee

[57] ABSTRACT

A forced air cooling apparatus having a blower for blowing air taken in from an intake surface or inlet of the blower to be blown against an electronic device in an installation wherein the blower is mounted for operation on a casing or a rack, and in which the apparatus has a flow regulating plate vertically intersecting the intake surface that is installed immediately before the intake surface. With this construction, eddy air current flow in the vicinity of the intake surface is prevented and the cooling ability obtained from the blower is optimized to thereby attain the effect that the electronic devices can be efficiently cooled without requiring the same separation distance between an intake surface of the blower and a wall surface of the frame or casing in which the blower is installed, as compared with a conventional installation of the same equipment in the same casing without the flow regulating plate.

10 Claims, 3 Drawing Sheets

FORCED AIR COOLING APPARATUS HAVING BLOWER AND AIR CURRENT REGULATING PLATE THAT REDUCES EDDY AIR CURRENT AT INLET OF BLOWER

FIELD OF THE INVENTION

The present invention relates to a forced air cooling apparatus, and particularly to a forced air cooling apparatus for cooling an electronic device which is operating within a casing or frame having a wall.

BACKGROUND OF THE INVENTION

Conventionally, a forced air cooling apparatus has a blower for creating cooling air that is forced to blow onto an electronic device operating within a casing or frame with walls. In the past, such an apparatus has been installed or mounted within the casing so that a distance between an air intake surface or structure at the inlet of the of the blower and a wall surface of the casing in which the blower is mounted is at least more than one half of a diameter of the inlet of the blower to thereby optimize the cooling ability obtained from the blower. For example, the invention disclosed in Japanese Patent Laid-Open No. 144600/1988 discloses such a conventional blower arrangement requiring above-mentioned separation distance for optimum performance.

SUMMARY OF THE INVENTION

In the above discussed prior art arrangement, a distance of more than one half of a diameter of a circular inlet structure of a blower is provided between the inlet of the blower and a wall surface of a casing (or frame having a wall and a rack on which the components are mounted) to thereby attain the optimum cooling effect for the blower installation. Accordingly, in the case where the aforesaid distance cannot be ensured by the installation conditions, such as constraints in the size of the blower or casing and the mounting position of the blower with respect to the wall of the casing, an eddy air current generated in the vicinity of the intake or inlet surface impairs the blower from taking in the maximum amount of intake air and thus the optimum cooling efficiency of the blower is not achieved. This leads to a problem in that the electronic device being operated cannot be efficiently cooled. Further, because of the diminished cooling effect that results from an installation having a less than adequate separation distance, it is not possible to cool an electronic device provided as a replacement of the originally installed one if the replacement has a larger heat value than the originally provided one for the same installation having the same scale. Still further, it is difficult with the conventional installation specifications governing the required separation distance between blower inlet and casing wall to minimize a forced air cooling apparatus without lowering its cooling ability.

It is an object of the present invention to solve the above-described problems and to provide a forced air cooling apparatus capable of efficiently cooling an electronic device even when a distance between an intake surface of a blower of the apparatus and a wall surface of a casing is desired that is less than that required by the installation specifications for a conventional forced air cooling apparatus installation.

For achieving the above objects, the present invention provides a forced air cooling apparatus having a blower for blowing air, taken in from an intake surface at an inlet of the blower, against an electronic device in an installation wherein the blower is mounted for operation on a casing or a rack, and in which the apparatus has a flow regulating plate vertically intersecting the intake surface that is installed immediately before the intake surface, with respect to the air flow direction.

In particular, in consideration of the installation of the blower of the present invention, the generation of eddy air currents in the vicinity of the air intake surface at the inlet of the blower is prevented, thereby permitting an optimum flow of intake air into the blower inlet to optimize the cooling efficiency of the blower. Accordingly, it is possible to efficiently cool an electronic device without requiring the same separation distance between an intake surface of the blower and a wall surface as is required by a conventional installation of the same equipment in the same casing without the flow regulating plate being provided as part of the installation.

DETAILED DESCRIPTION OF THE PREFERRED EMBODIMENT

One embodiment of the forced air cooling apparatus according to the present invention will be described in detail hereinafter with reference to the drawings.

Figure 1:
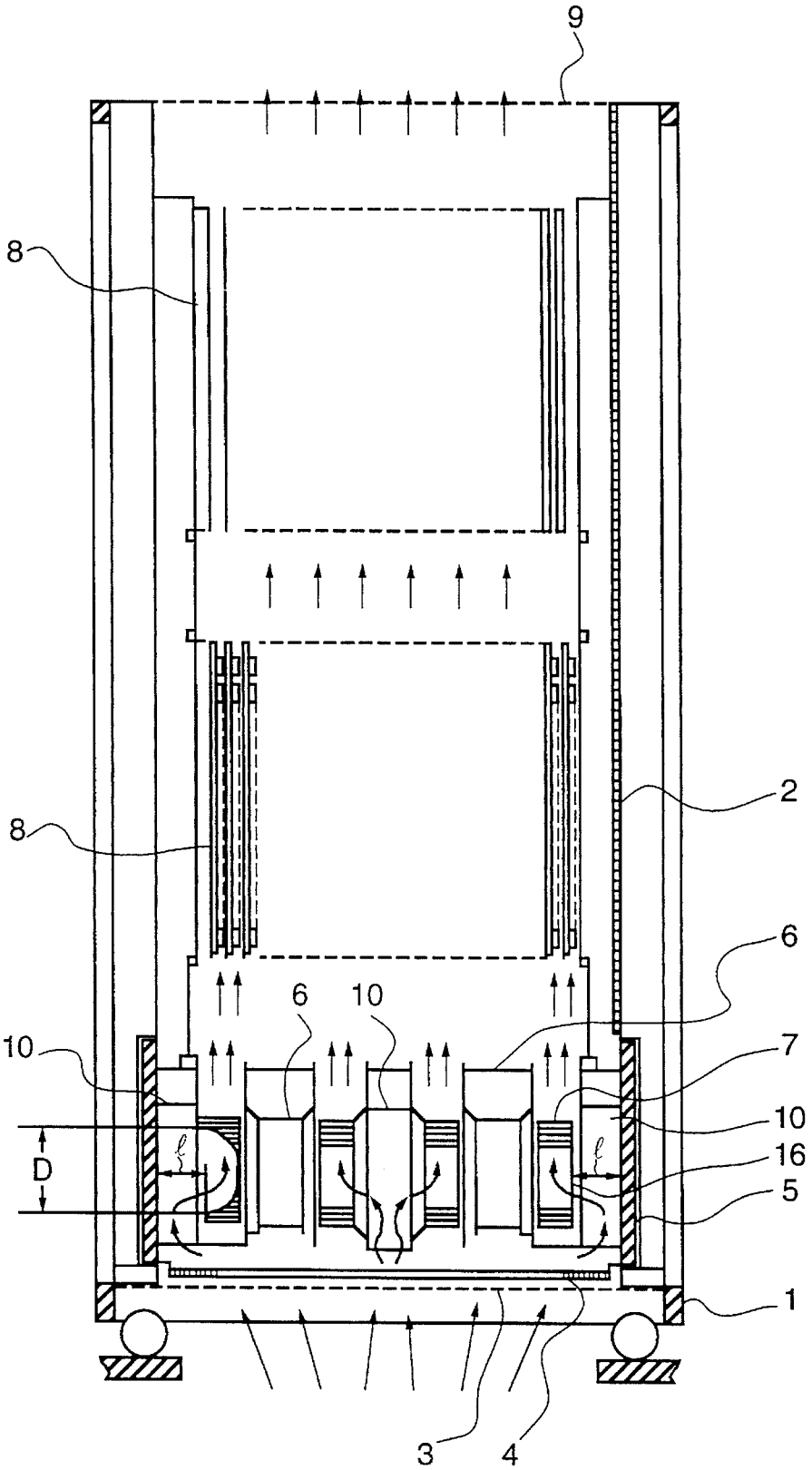
FIG. 1 is a partial sectional view showing one example of the construction of a system to which a forced air cooling apparatus of the present invention is applied.

FIG. 1 is a sectional view showing one example of an installation or construction of a system in which the forced air cooling apparatus of the present invention is included. The arrangement of FIG. 1 includes a casing generally having a frame 1; a rack 2 mounted on the frame 1; a floor punching 3; an air filter 4; a wall 5 and a ceiling punching 9. Within the casing are a blower 6 having an impeller 7; and an electronic circuit, unit or device 8 (corresponding to the above discussed electronic device) mounted on the rack 2. The ceiling punching 9 and the floor punching 3 are mounted on the frame 1, and the air filter 4 is provided to clean air used as cooling air. The blower 6 is used to cool the electronic circuit units 8.

Figure 2A:
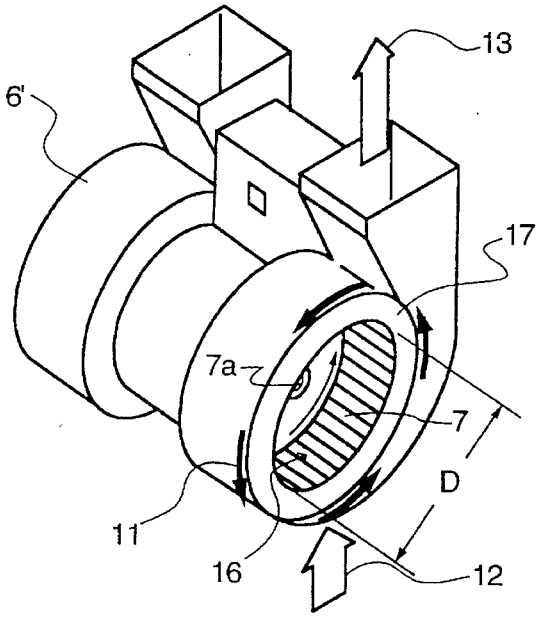
FIG. 2(A) PRIOR ART
FIGS. 2(A) and 2(B) are perspective views respectively explaining the detailed construction of a conventional blower that generates eddy current air flow; and a blower as shown in FIG. 1 provided with an air current regulating plate according to the present invention.
Figure 2B:
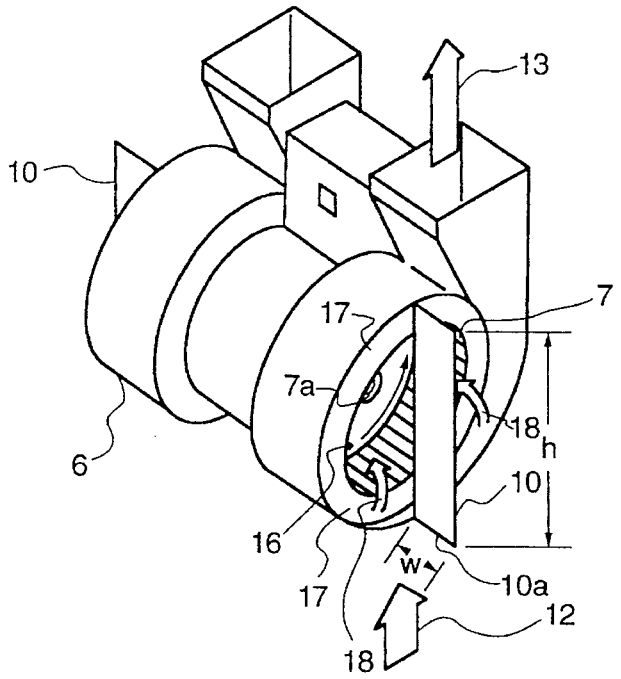

FIGS. 2(A) and 2(B) are perspective views respectively explaining the detailed construction of a conventional Sirocco type blower 6' of the prior art, FIG. 2(A), and the Sirocco type blower 6 according to the present invention installed with the air current regulating plate 10 immediately before the intake surface of the blower, shown in FIG. 2(B). In these drawings, the same parts as those shown in FIG. 1 are designated by the same reference numerals, which explanations are omitted.

As shown in FIG. 1 and also in 2(B), the air current regulating plate 10 is installed adjacent an inlet 16 of blower 6. Impeller 7 of blower 6 has an inside diameter D that is used as a dimension to define the relative distance l between an intake surface 17 of the blower 6 and the inside surface of the wall 5 of the casing. Preferably, the blower is of the Sirocco type, in which air is drawn in from the side of the impeller 7 and discharged at right angles to a rotating axis 7*a* of the impeller.

The air current regulating plate 10 is preferably installed immediately before the intake surface 17 (with respect to the direction of air flow being drawn into the blower) at the blower inlet 16, preferably in a vertical orientation intersecting the intake surface of the blower 6, perpendicularly, substantially as shown in FIG. 2(B). The size and orientation of plate 10 prevents the air being drawn into the side of the impeller 7 from having an eddy current 11. The arrows 18 shown in FIG. 2(B) indicate the flow of cooling air generated by the Sirocco type blower 6 with the air flow regulating plate 10.

Although FIG. 2(A) shows a detailed conventional Sirocco type air blower 6'. The figure shows the recognition of eddy air current 11 that is generated around the intake surface or inlet of the blower. Specifically, arrow 12 shows the main component of intake air flow into the blower inlet, which comes up through the floor punching 3. It is shown that eddy air current 11 flows around the inlet without contributing to the main component of air flow 12, thus preventing efficient operation of the blower by reducing the volume of intake air that is drawn into the blower. This eddy air current 11 is generated in the case where the distance l is not sufficiently provided, i.e. $l<(D/2)$ as opposed to $l\geqq(D/2)$, which is the distance that is required in a conventional arrangement of the same components as shown in FIG. 1 (without the air current regulating plate 10) for optimum intake air flow. The eddy current air flow is a component of the intake air that goes around in the same direction as the rotating direction of the impeller 7.

On the other hand, as shown in FIG. 2(B), the air current regulating plate 10 is provided to prevent the eddy air current. Preferably, air current regulating plate 10 is provided in the form of a flat plate having a fixed height h that is preferably at least (D/2) and a width w that is the same dimension as the distance l. The plate 10 is installed to have a planar body portion extend in the same direction as the main air flow direction 12, immediately before the intake surface 17, which is adjacent the inlet 16. Preferably, the plate 10 vertically intersects the intake surface (in alignment with the axis 7*a* of the impeller) since the direction of air flow into the casing is generally vertical. This causes the eddy air current to be reduced or eliminated so that the flow of the intake air 12 is introduced into the impeller 7 following arrows 18, as shown in FIG. 2(B). Further, since the body of the air current regulating plate 10 is provided so that its planar expanse extends in parallel with the direction of the flow of the intake air 12, the intake air 12 rarely receives a pressure loss due to the presence of the air current regulating plate 10. That is, the plate 10 is mounted so that it does not substantially block the air flow 12 entering the casing and flowing into the inlet of the blower. In the preferred embodiment shown, only the lower end face 10*a* of the plate is directed against the current of air flowing toward the inlet 16 of the blower.

According to the invention, it is possible to improve the efficiency of the blower 6 over the case where the air current regulating plate 10 is not provided. According to the invention, the mounting of the air current regulating plate 10 can be either on the blower 6 or on the rack 2, depending upon the installation. Further, if the eddy air current 11 can be prevented from being generated without imparting a pressure loss to the intake air 12, an air current regulating plate 10 having a curved shape or a bent shape may be installed, or a plurality of air current regulating places 10 may be disposed in a vertical or lateral arrangement.

As described above, according to the present embodiment, since the eddy air current 11 in the vicinity of the intake surface is prevented from being generated, it is possible to optimize the cooling ability obtained from the blower 6 for efficiently cooling the electronic circuit units 8 without requiring the same separation distance l between an intake surface 17 of the blower 6 and a surface of the wall 5 of the frame or casing 1 as is required by a conventional installation of the same equipment in the same casing without the flow regulating plate 10.

If an improvement in efficiency of the blower 6 due to the installation of the air current regulating plate 10 is suitably balanced with an increase in pressure loss due to the reduction of the distance l, it is possible to cool the electronic circuit units 8 having a larger heat value by the blower 6 having the same scale or to miniaturize the electronic devices by reducing the width of the blower 6 and the rack 2 without lowering the cooling ability.

Figure 3:
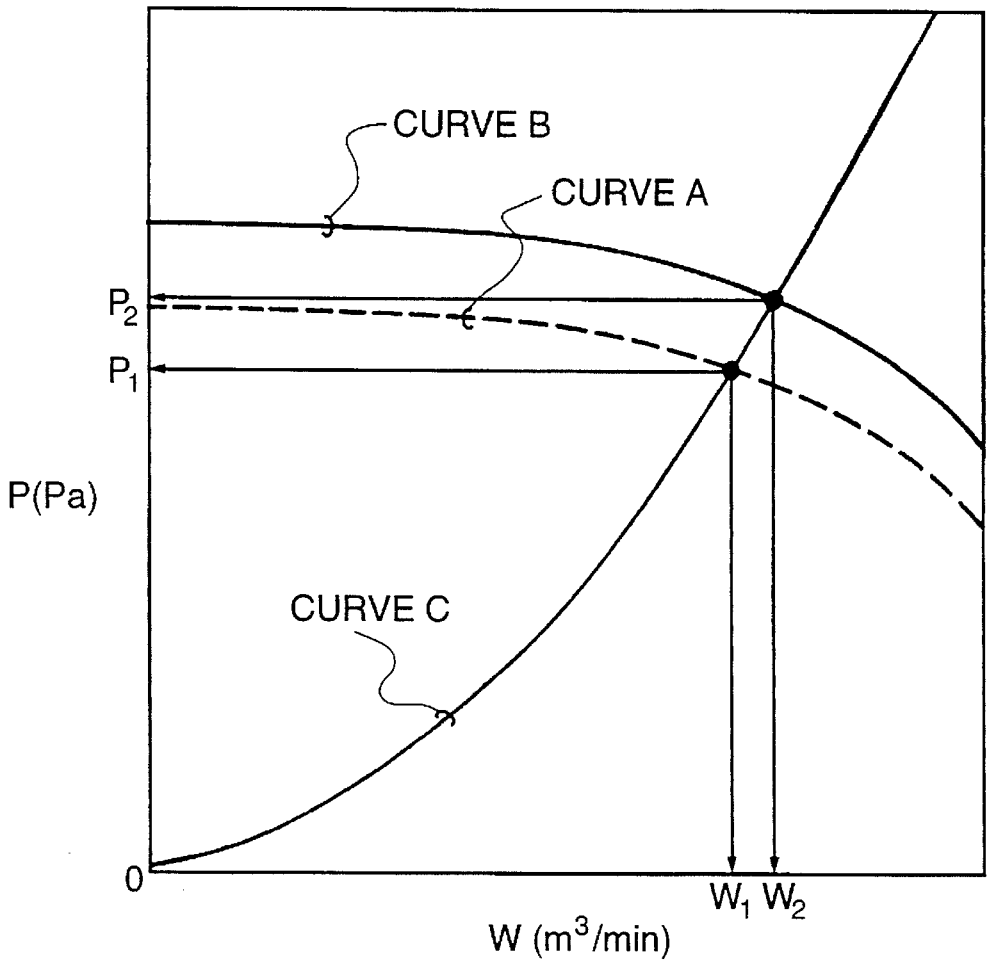
FIG. 3 is a graph comparing the performance curves for a conventional Sirocco type blower (curve A) and a Sirocco type blower installed or modified according to the present invention (curve B).

The results of comparative testing of the invention with a conventional blower installation are shown in FIG. 3. For the comparison, a cabinet of a M 860 general computer of Hitachi, Ltd. was used. The conventional blower installation that was used for the comparison is the same as that shown in FIG. 1, except for the use of the blower 6'. Blower 6' was positioned a distance l from the wall of the casing according to the conventional arrangement and $l<(D/2)$. No air regulating plate 10 was provided for the conventional installation. To compare the conventional installation with that of the invention, the same installation as shown in FIG. 1 was used, but the blower 6 was fitted with an air regulating plate 10, as shown in FIG. 2(B). The test was conducted to determine whether an increase in blower performance would result from using the air current regulating plate in combination with the blower being installed at a distance of l from the wall 5 of the cabinet or frame 1.

The results of FIG. 3 show that for a Sirocco type blower having a known pressure loss performance curve C, a blower performance curve A was observed for the conventional installation of the blower, without the air regulating plate 10 in an installation wherein the intake surface 17 at the inlet 16 of the blower 6' is spaced a distance l from the wall 5 of the casing. For the same installation using blower 6, having an air regulating plate 10 of a height h at least as great as that of the diameter D of the inlet opening, i.e. spanning the inlet 16 of the blower 6, a blower flow rate performance curve B was obtained. A comparison between curves A and B shows that an increase in performance is obtained when air regulating plate 10 is used, as represented by curve B. In particular, a flow rate of the cooling air increased from $W_1=20(m^3/min)$ for blower 6' to $W_2=23(m^3/min)$ for blower 6, which represents a 15% increase in air flow rate. The increase is believed to result from the reduction or elimination in the eddy current air flow 11.

As described above in detail, according to the present invention, there is provided a forced air cooling apparatus having a blower for blowing air taken in from an intake surface or inlet of the blower to be blown against an electronic device in an installation wherein the blower is mounted for operation on a casing or a rack, and in which the apparatus has a flow regulating plate vertically intersecting the intake surface that is installed immediately before the intake surface. With this construction, eddy air current flow in the vicinity of the intake surface is prevented and the cooling ability obtained from the blower is optimized to thereby attain the effect that the electronic devices can be efficiently cooled without requiring the same separation distance l between an intake surface of the blower 6 and a wall surface 5 of the frame or casing 1 as is required by a conventional installation of the same equipment in the same casing without the flow regulating plate 10.

We claim:

1. A forced air cooling apparatus for a casing having a frame, a rack mounted on the frame, a floor punching through which air enters the casing in a predetermined direction, at least one wall, a ceiling punching through which air exits the casing, a blower having an impeller, and a device onto which air entering the casing through said floor punching is blown by said blower, comprising:

the blower having an inlet through which intake air enters at a side of the impeller and an outlet through which air exits the blower perpendicular to an axis of said impeller;

an air current regulating plate mounted to one of said blower and said casing adjacent said inlet of said blower for reducing eddy air current adjacent said inlet of the blower;

wherein said plate has a planar body portion that extends parallel with said predetermined direction of air flow into the casing;

wherein said impeller has an inside diameter D and wherein a height of said plate is at least (D/2); and wherein a distance l between an intake surface of the blower and an inside surface of the wall of the casing is less than (D/2).

2. A forced air cooling apparatus according to claim 1, wherein the plate has a width of distance l.

3. A forced air cooling apparatus according to claim 1, wherein the blower is of the Sirocco type.

4. A forced air cooling apparatus according to claim 1, wherein said plate is installed immediately before an intake surface with respect to the direction of air flow being drawn into the blower at the blower inlet.

5. A forced air cooling apparatus according to claim 1, wherein said plate is installed perpendicularly in a vertical orientation intersecting an intake surface of the blower.

6. A forced air cooling apparatus for a casing having a frame, a rack mounted on the frame, a floor punching through which air enters the casing, at least a pair of walls, a ceiling punching through which air exits the casing, a plurality of blowers, at least one device onto which air entering the casing through said floor punching is blown by said blowers, comprising:

each of the blowers having an impeller, an inlet through which intake air enters at a side of the impeller and an outlet through which air exits the blower perpendicular to an axis of said impeller;

a plurality of air current regulating plates, one of said plates mounted to one of said blower and said casing adjacent each of said inlets of said blowers for reducing eddy air current adjacent said inlets of the blowers;

wherein each said plate has a planar body portion that extends parallel to a direction of air flow into the casing adjacent said blower to which said plate corresponds;

wherein each said impeller has an inside diameter D and height of each said plate is at least (D/2); and wherein a distance l between an intake surface of each of the blowers and an inside surface of an adjacent one of the walls of the casing is less than (D/2).

7. A forced air cooling apparatus according to claim 6, wherein each said plate has a width of distance l.

8. A forced air cooling apparatus according to claim 6, wherein each of the blowers is of the Sirocco type.

9. A forced air cooling apparatus according to claim 6, wherein each said plate is installed immediately before an intake surface with respect to the direction of air flow being drawn into a corresponding one of the blowers at the inlet thereof.

10. A forced air cooling apparatus according to claim 6, wherein each said plate is installed perpendicularly in a vertical orientation intersecting an intake surface of the blower.

* * * * *